US005314012A

United States Patent [19]

Mosse et al.

[11] Patent Number: 5,314,012

[45] Date of Patent: May 24, 1994

[54] APPARATUS FOR EFFECTING HEAT EXCHANGE BETWEEN A LIQUID AND A PARTICULATE MATERIAL

[75] Inventors: Richard W. E. Mosse, London; Nicholas K. Franklin, Hitchin, both of England

[73] Assignee: Beckswift Limited, London, England

[21] Appl. No.: 980,611

[22] Filed: Nov. 20, 1992

[30] Foreign Application Priority Data

Nov. 22, 1991 [GB] United Kingdom ..... 9124863

[51] Int. Cl.[5] ..... A23L 1/00; A47J 37/00

[52] U.S. Cl. ..... 165/111; 165/120; 99/404

[58] Field of Search ..... 165/111, 111 DC, 112, 165/120; 99/404, 443 C, 483

[56] References Cited

U.S. PATENT DOCUMENTS

| | | | |
|---|---|---|---|
| 690,005 | 12/1901 | Anderson et al. | 99/404 |
| 1,993,264 | 3/1935 | Duttweiler | 165/120 X |
| 3,086,444 | 4/1963 | De Back | 99/404 X |
| 3,181,955 | 5/1965 | Altman | 99/443 C X |
| 3,263,748 | 8/1966 | Jemal et al. | 165/120 X |
| 3,578,417 | 5/1971 | Dale | 165/120 X |
| 4,039,024 | 8/1977 | List | 165/120 X |
| 4,181,072 | 1/1980 | Hirahara | 99/404 X |
| 4,353,725 | 10/1982 | Hohman et al. | 165/111 DC X |
| 4,444,553 | 4/1984 | Christodoulou | 99/443 C X |
| 4,567,941 | 2/1986 | Coppolani et al. | 165/111 |

FOREIGN PATENT DOCUMENTS

| | | |
|---|---|---|
| 866208 | 4/1961 | United Kingdom . |
| 1223792 | 3/1971 | United Kingdom . |
| 1264111 | 2/1972 | United Kingdom . |
| 1429767 | 3/1976 | United Kingdom . |
| 1453972 | 10/1976 | United Kingdom . |
| 2223926 | 4/1990 | United Kingdom . |

*Primary Examiner*—John Rivell

*Attorney, Agent, or Firm*—Cushman, Darby & Cushman

[57] ABSTRACT

Apparatus for heating and/or cooling a particulate material, e.g. vegetables, by heat exchange with a liquid comprises a horizontal tubular chamber of waisted internal cross-section containing a rotatable mesh cylinder having an auger blade corotatable therein. A row of inlets for heat exchange liquid along the bottom of the chamber are connected via external pipe work to a row of outlets for heat exchange liquid at the top of the chamber. Upward flow of heat exchange liquid causes suspension of particulate matter as it is conveyed through the chamber by the auger, thus minimizing rubbing contact on the particulate material. The apparatus includes a heating section defined by inlets A–D, a holding section defined by inlets E to L, and a cooling section defined by inlets M to Q, all within a common chamber. Within each section, each outlet is connected externally to the alphabetically preceding inlet except for the leftmost outlet which is connected to the rightmost inlet. The heating and cooling flows recover heat via a regenerative heat exchanger.

18 Claims, 2 Drawing Sheets

APPARATUS FOR EFFECTING HEAT EXCHANGE BETWEEN A LIQUID AND A PARTICULATE MATERIAL

FIELD OF THE INVENTION

The present invention relates to apparatus for effecting heat exchange between a liquid and a particulate material, for instance for heating a particulate material immersed in a liquid.

BACKGROUND TO THE INVENTION

A common operation in the foodstuff industries is to heat a particulate foodstuff material, e.g. vegetables, contained in a liquid which is commonly water. For instance, vegetables such as peas or carrot slices are heated to about the boiling point of water for a period to cook the vegetables or alternatively to sterilise them. Because of rubbing contact between the foodstuff particles and the container through which they are transported during heating, the liquid within which the foodstuff particles are contained tends to become discoloured with material abraded from the foodstuff particles. Also, in a continuous system, it is difficult to ensure that the time of passage of the foodstuff particles is sufficiently uniform that none are overcooked if none are to be undercooked.

Apparatus for this purpose is known in GB-A-1223792, in which the particulate product is contained within a horizontal perforate sleeve containing an auger which drives the product along the sleeve. The sleeve is contained in an elongate treatment chamber and a heating liquid is passed into the sleeve along its bottom and withdrawn with the product at its downstream end.

No very intimate contact and mixing between the heated liquid and the product is easily achieved as there is a direct path between the liquid inlet and outlet involving little contact with the particulate material. The liquid and particulate flows are co-current so that the incoming liquid will have to be heated much in excess of the desired end temperature of the product.

Counter current arrangements are shown in GB-A-1453972 and U.S. Pat. No. 4,567,941 in which the sleeve is non-perforate and the liquid is introduced at the downstream (with respect to product conveyance) end of the sleeve and withdrawn at the opposite end.

None of these specifications address the problem of preventing or reducing rubbing of the products. A separate problem left unresolved by these teachings is the need to hold the product at an ideal heat treatment temperature for a desired period once its temperature has been raised and in some cases to reduce the temperature sharply at the end of the heat treatment. It would be desirable to develop forms of apparatus in which, after heating, the product can be kept at a holding temperature and/or cooled in the same treatment chamber.

SUMMARY OF THE INVENTION

The present invention in a first aspect provides apparatus for effecting heat exchange between a liquid and a particulate material comprising a heat exchange chamber preferably extending at no more than 45° to the vertical having a inlet for particulate material and an outlet for particulate material spaced from said inlet along said chamber, mechanical conveyor means for conveying said particulate material from said inlet to said outlet, a plurality of inlets into said chamber at a low level for heat exchange liquid spaced between said inlet and said outlet for particulate material and outlets from said chamber at a high level for heat exchange liquid spaced between said inlet and said outlet for particulate material, whereby flow of heat exchange liquid transversely through the chamber between said inlets and said outlets for heat exchange liquid may be employed to suspend said particulate material in said chamber in use.

The mechanical conveyor is preferably a screw conveyor and preferably this comprises a helical blade element or auger contained in a tubular carrier of matching diameter in which the blade element is rotatable or with which said blade element is co-rotatable. The blade element may for instance be sealed and secured about its periphery to the interior of the tubular carrier, for instance by adhesive or welding or simply by an adequately tight fit.

The tubular carrier is preferably permeable to said heat exchange fluid. For instance, the tubular carrier may be a perforated tube. It may be perforated along its entire length or may be perforated only at spaced locations corresponding to the location of said inlets and outlets for heat exchange liquid.

There are a plurality of inlets to the said chamber for heat exchange liquid and a plurality of outlets for heat exchange liquid. Preferably, for each inlet for heat exchange liquid there may be a corresponding outlet for heat exchange liquid spaced therefrom in the direction of the outlet for particulate material.

The inlet and outlet for particulate material of said chamber are preferably spaced in a direction which is no more than 45° to the horizontal, preferably such that the overall direction of conveyance of particulate material is at no more than 30° to the horizontal e.g. at no more than 10° to the horizontal. Preferably, the overall direction of conveyance of the particulate materials is horizontal.

Each said inlet for heat exchange material is preferably positioned on the underneath of said chamber and each said outlet for heat exchange material is preferably positioned on the top of the chamber if the chamber is to be operated full of the heat exchange liquid. If the chamber is only to be partially filled, the outlets will need to be positioned on the sides of the chamber below the level of fill.

If the mechanical conveyor used is a screw conveyor submerged in the heat exchange liquid, it will be possible for particulate material to follow a helical course through the chamber at a rate different from the rate at which the screw conveyor would otherwise transport the particulate material. Generally, such helical flow is likely to be engendered if there is a significant flow of heat exchange liquid along the axis of the screw conveyor over a distance exceeding the distance between adjacent flights of the screw conveyor.

However this tendency to helical flow can be avoided if the chamber is only part filled such that there is no helical flow path over the screw conveyor blade element within the depth of the heat exchange liquid.

The apparatus may further comprise means for pumping said heat exchange liquid to flow through the inlet for heat exchange liquid into the chamber and from the outlet for heat exchange liquid back to the inlets for heat exchange liquid.

A group of said inlets may be fed from a common manifold or otherwise by a common pumping means and a corresponding group of said outlets may be similarly connected.

Preferably the means for pumping is so arranged as to pump said heat exchange liquid from each of a plurality of said outlets to a respective inlet located more upstream with respect to the conveyor, except that the most upstream one of said heat exchange liquid outlets (with respect to the direction of conveyance by the conveyor) or the most upstream said outlet (with respect to said conveyor) in a group of said outlets and inlets is connected to the most downstream one of said inlets or the most downstream inlet in said group (with respect to the conveyor).

The apparatus may comprise a heating section and a cooling section, wherein each said section comprises a group of said inlets and a group of said outlets for heat exchange liquid, said sections being spaced along a common said chamber.

In a further aspect, the invention provides apparatus for effecting heat exchange between a liquid and a particulate material comprising an elongate heat exchange chamber having an inlet for particulate material, an outlet for particulate material spaced longitudinally from said inlet, mechanical conveyor means for conveying said particulate material from said inlet to said outlet, a plurality of inlets for heat exchange liquid into said chamber and a plurality of outlets for heat exchange liquid from said chamber transversely spaced in said chamber from said inlets for heat exchange liquid, wherein the chamber comprises a heating section and a cooling section and each said section comprises at least one said inlet and outlet for heat exchange liquid and wherein the apparatus further comprises means for circulating a hotter heat exchange liquid through said chamber heating section via said at least one inlet and said at least one outlet for heat exchange liquid in the heating section and further comprises means for circulating a cooler heat exchange liquid through said chamber cooling section via said at least one inlet and said at least one outlet for heat exchange liquid in said cooling section.

There may be a holding section between the heating section and the cooling section. The holding section itself may comprise at least one said inlet and at least one said outlet for heat exchange liquid.

Means may be provided for heating the heat exchange liquid used in the holding section.

Heat exchange means may be provided for exchanging heat between the heat exchange liquid used in the heating section and the heat exchange liquid used in the cooling section so as to transfer heat from the latter to the former.

Thus there may further be heat exchange means for exchanging heat between the heat exchange fluid exiting from the most upstream outlet (with respect to said conveyor) in the heating section and the heat exchange fluid exiting from the most upstream outlet (with respect to said conveyor) in the cooling section, so as to reheat the heat exchange fluid to be introduced at the downstream end (with respect to said conveyor) of the heating section and cool the heat exchange fluid to be introduced at the downstream end (with respect to said conveyor) of the cooling section.

The invention includes a method of heating or cooling a particulate material comprising conveying the particulate material through a chamber by means of a mechanical conveyor whilst said particulate material is immersed in a heat exchange liquid, withdrawing some of said liquid from an upper part of the chamber at each of a plurality of points spaced longitudinally with respect to the conveyor and reintroducing said withdrawn liquid into a lower part of said chamber at each of a plurality of points spaced longitudinally with respect to the conveyor to heat or cool said particulate material, and to suspend said material in said upwardly flowing liquid. Such a method may be practised using apparatus having any of the features described above in respect of apparatus according to the invention.

Whilst the apparatus and method described above have particular relevance to the processing of foodstuffs, they may be used in conjunction with the processing of other particulate materials.

Preferably however, the particulate materials are such that they can be suspended by an upward flow of the heat exchange liquid in the chamber. In such a suspended state, there will be essentially no rubbing contact between the particulate materials and the walls of the chamber as the particles are conveyed from the inlet for the particulate material to the outlet for particulate material. In particular, if the conveyor means is a screw conveyor comprising an auger flight and a co-rotatable tubular carrier, such particulate material may be suspended in the upward flow of liquid, as in a fluid bed, and in the suspended state may be floated gently through the chamber with minimum mechanical damage.

Where the conveyor means is such a screw conveyor, the chamber is preferably a tubular member coaxial with the screw conveyor contained within it. The interior wall of the chamber preferably has a waisted cross-section so that there is little or no clearance between the interior wall of the chamber and the external wall of the tubular carrier in a plane containing the waist of the chamber, which plane is preferably horizontal and preferably coincides with a horizontal diameter of the section of the tubular carrier. By virtue of the waisted shape of the cross-section of the chamber however, the whole of the area of the tubular carrier is available for the ingress of heat exchange liquid and the egress of heat exchange liquid in the vicinity of the inlets and outlets for heat exchange liquid.

Optionally, baffle plates may be provided between adjacent inlets for heat exchange liquid and between adjacent outlets for heat exchange liquid outside of the tubular carrier so as to restrain axial flow of heat exchange liquid within the chamber but outside the tubular carrier of the screw conveyor.

Whilst it is preferred that the auger of the screw conveyor be co-rotatable with the tubular carrier, it is possible to use a stationary tubular carrier and a rotatable auger.

BRIEF DESCRIPTION OF THE DRAWINGS

The invention will be illustrated by the following description of a preferred embodiment with reference to the accompanying drawings in which.

DESCRIPTION OF PREFERRED EMBODIMENT

Figure 1:
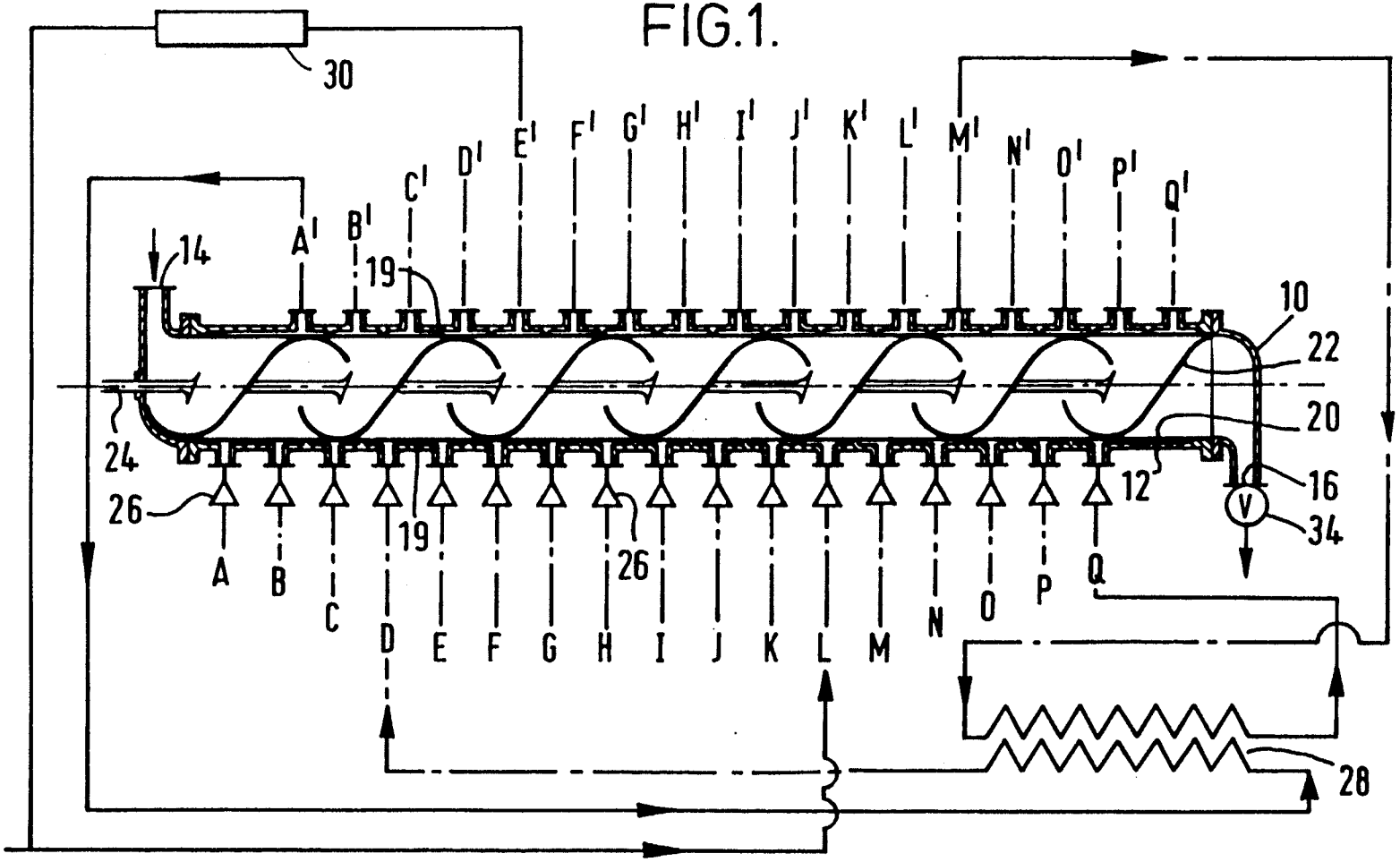
FIG. 1 is a schematic longitudinal cross-section through apparatus according to the invention.
Figure 2:
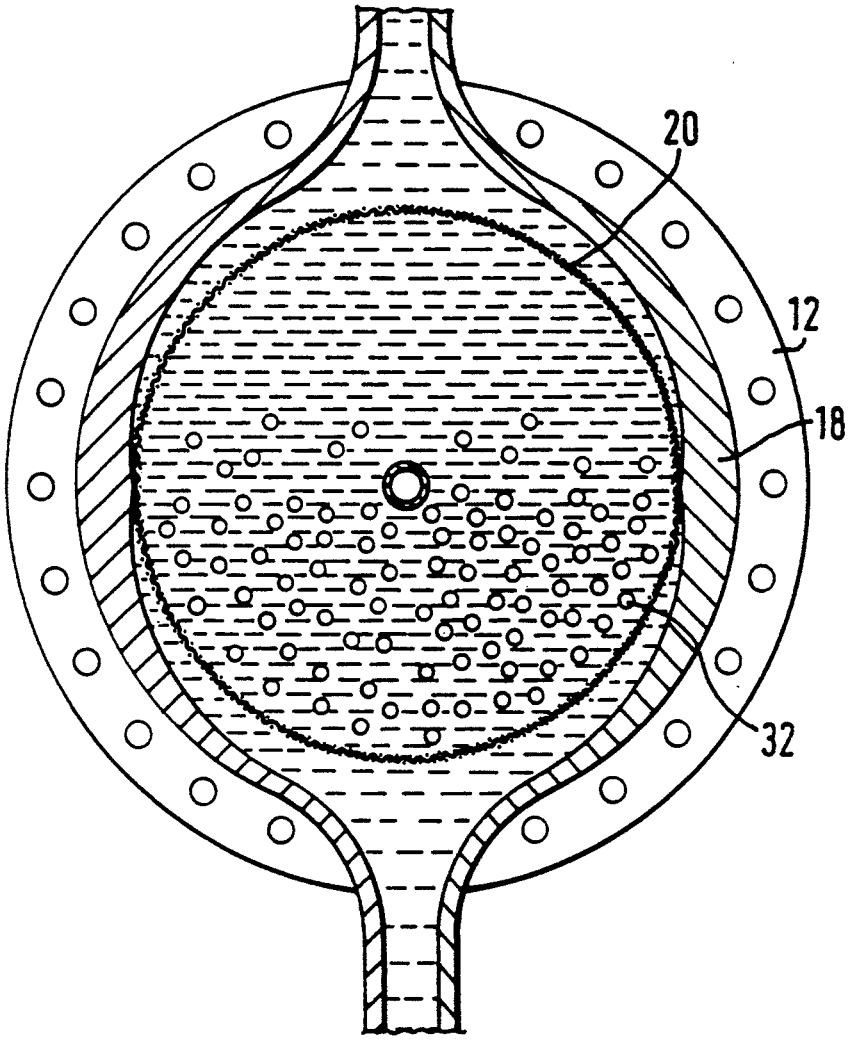
FIG. 2 is a transverse cross-section on the line C'–D of FIG. 1.

As shown in FIG. 1, apparatus 10 according to the invention comprises a generally cylindrical tubular chamber 12 having at one end an inlet 14 for particulate material such as vegetables in water and at the other end an outlet 16 for the particulate material. Along the top surface of the chamber 12 are arranged a series of outlets A'-Q' for heat exchange fluid and along the bottom surface of the chamber are arranged a series of inlets A-Q for heat exchange fluid. The outlets are staggered with relation to the inlets by a constant amount in the direction of the outlet 16. Within the chamber 10 there is provided a fixed liner 18 (FIG. 2). This is shaped so as in cross-section to have a waist region of reduced diameter running along the horizontal mid-plane of the chamber 12. A stainless steel mesh tubular carrier 20 extends substantially the length of the chamber 12. The space between the tubular carrier 20 and the fixed liner 18 is divided into axially sequential zones by baffles 19. Secured by welding to the interior of the tubular carrier 20 is a helical blade element 22 having a central shaft 24 which exits from the left-hand end of the chamber 12 through a liquid tight sealing gland. The helical blade element 22 and the tubular carrier 20 form a screw conveyor which is rotatable by rotation of the shaft 24.

Each of the inlets A-Q is provided with a respective pump means 26 for pumping heat exchange fluid therethrough into the chamber 12.

Externally, the inlets A-Q and outlets A'-Q' are connected as follows. A first circuit consists of inlets A-D and outlets A-D'. Outlet A' is connected via one side of a counter-current heat exchanger 28 to inlet D. Outlet D' is connected by external pipework to inlet C. Outlet C' is connected by external pipework to inlet B and outlet B' is connected by external pipework to inlet A.

A second circuit is formed by inlets E-L and outlets L'-E'. Outlet E' is connected via heater 30 to inlet L. Outlets L'-F' are each connected by respective external pipework to inlets K-E. In a first alternative arrangement, not shown in the drawing, outlet L' is connected via the heater 30 to inlet E and outlets E'-K' are connected by external respective pipework to inlets F-L.

In a second alternative arrangement not illustrated in the drawings, all of the outlets E'-L' are connected to a common manifold and a single pipework connection is made to a common inlet manifold supplying inlets E-L, heater 30 being interposed in said external connection between the manifolds.

A third circuit comprises inlets M-Q and outlets M'-Q'. Outlet M' is connected via the second side of the counter-current heat exchanger 28 to inlet Q and outlets Q'-N' are connected by respective external pipework to inlets P-M.

In use, a suspension of a particulate material 32 (FIG. 2) in water is supplied to the inlet 14. Optionally, the apparatus may be pressurised and the particulate material may be fed to inlet 14 from a pressurisable supply such as a closed hopper. A pressure relief valve 34 may be provided at the outlet 16.

The particulate material is conveyed through the chamber from the inlet 14 to the outlet 16 by rotation of the screw conveyor, e.g. at from 20 to 120 rpm. The screw conveyor defines a series of essentially isolated pockets in which the particles are transported. If conditions are adjusted so that there is no tendency to helical flow of the carrying liquid through the chamber, the particles will remain in these essentially isolated pockets as they move through the apparatus.

The particles are suspended by the upward flow of liquid through the inlets A-Q which is forced into the interior of the screw conveyor by the restricted waist of the liner 18. The upward flow of the heat exchange liquid tends to sweep clean the orifices of the perforated tubular carrier 20.

The heat exchange liquid which is circulated is of course the same as the liquid in which the particulate material is suspended. At each inlet, the liquid which is injected mixes with the liquid suspending the particles and a corresponding volume of liquid is withdrawn through the corresponding outlet staggered from the inlet in the direction of the outlet from the chamber. Heated liquid injected at D follows therefore an essentially counter-current course to the particulate material within the chamber as the volume of liquid corresponding to the volume injected at D is withdrawn at D' and fed back in at C and so on until the liquid is withdrawn at A' and returned to the heat exchanger 28. The particulate material is therefore heated by counter-current exchange in the first region of the heat exchanger. In the end region of the heat exchanger, the particulate material is cooled in a similar manner by counter-current heat exchange. Cool heat exchange liquid is injected at Q and withdrawn at Q' and recycled to P and so on eventually emerging at M' to be returned to the heat exchanger 28. In the heat exchanger 28, heated exchange fluid from M' is cooled in counter-current with cool heat exchange liquid from A'. Cooled heat exchange liquid exiting the heat exchanger is returned at Q and reheated heat exchange liquid exiting the heat exchanger is returned at D. Thermal losses in the apparatus are made up by the heater 30 through which passes the heat exchange liquid used in the central holding region of the apparatus where temperatures are maintained essentially constant.

By way of example, a product flow containing vegetables at 25° C. may be received at the inlet 14 and heated to 130° C. in the first region, maintained at 130° C. in the holding region and finally cooled to approximately the starting temperature in the final region.

Although it will be less thermally efficient, it is within the scope of the invention for the inlets A-D to be connected to a common manifold and for the outlets A'-D' to be connected to a second manifold, these two manifolds being linked by external pipework via a heater. Similarly, the inlets M-Q and the outlets M'-Q' may be connected in a similar manner through a cooler.

Many other variations and modifications of the apparatus shown in the drawings are possible. For instance, the apparatus may be operated with the chamber only partly filled with liquid, the outlets A'-Q' being relocated to the side of the chamber.

In place of pumps 26 at the inlets A-Q, one may employ impellers at the outlets A'-Q'. One may connect some or all of the inlets within the heating section or within the cooling section and feed them in common and one may treat the outlets similarly.

We claim:

1. Apparatus for effecting heat exchange between a liquid and a particulate material, said apparatus comprising:

a heat exchange chamber having an inlet for particulate material and an outlet for particulate material spaced from said inlet along said chamber, screw conveyor means for conveying said particulate material from said inlet to said outlet, said screw conveyor means comprising a helical blade element contained in a tubular carrier of matching diameter with which said blade element is co-rotatable, said tubular carrier being permeable to said heat exchange liquid, a plurality of inlets into said chamber at a low level for heat exchange liquid, said plurality of inlets being spaced between said inlet for particulate material and said outlet for particulate material, and a plurality of outlets from said chamber at a high level for said heat exchange liquid, said plurality of outlets being spaced between said inlet for particulate material and said outlet for particulate material, whereby flow of heat exchange liquid transversely through the chamber between said inlets for heat exchange liquid and said outlets for heat exchange liquid is employed in use to suspend said particulate material in said chamber.

2. Apparatus as claimed in claim 1, wherein the chamber is a tubular member coaxial with the screw conveyor contained within it.

3. Apparatus as claimed in claim 2, wherein an interior wall of the chamber has a waisted cross-section so that there is substantially no clearance between the interior wall of the chamber and an external wall of the tubular carrier in a plane containing the waist of the chamber.

4. Apparatus as claimed in claim 3, wherein said plane is horizontal and coincides with a horizontal diameter of the section of the tubular carrier.

5. Apparatus as claimed in claim 2, wherein baffle plates are provided in said chamber between adjacent inlets for heat exchange liquid and between adjacent outlets for heat exchange liquid outside of the tubular carrier so as to restrain axial flow of heat exchange liquid within the chamber but outside the tubular carrier of the screw conveyor.

6. Apparatus as claimed in claim 1, wherein each inlet for heat exchange material is positioned underneath said chamber.

7. Apparatus as claimed in claim 1, wherein each outlet for heat exchange material is positioned atop said chamber.

8. Apparatus as claimed in claim 1, wherein for each outlet for heat exchange liquid there is a corresponding inlet for heat exchange liquid spaced therefrom in a direction of the outlet for particulate material.

9. Apparatus as claimed in claim 1, further comprising means for pumping said heat exchange liquid to flow through the inlets for heat exchange liquid into said chamber and from the outlets for heat exchange liquid to the inlets for heat exchange liquid.

10. Apparatus as claimed in claim 9, wherein said means for pumping is so arranged as to pump said heat exchange liquid from each of a plurality of said outlets for heat exchange liquid to a respective inlet located more upstream with respect to said conveyor means, except that a most upstream one of said heat exchange liquid outlets with respect to the conveyor means or a most upstream outlet with respect to the conveyor means in a group of outlets and inlets is connected to a most downstream one of said inlets with respect to said conveyor means or a most downstream inlet in said group.

11. Apparatus as claimed in claim 1, said apparatus further comprising a heating section and a cooling section, wherein each said section comprises a group of said inlets for heat exchange liquid and a group of said outlets for heat exchange liquid, said sections being spaced along said chamber.

12. Apparatus for effecting heat exchange between a liquid and a particulate material, said apparatus comprising:

an elongate heat exchange chamber having an inlet for particulate material and an outlet for particulate material spaced longitudinally from said inlet for particulate material, mechanical conveyor means for conveying said particulate material from said inlet to said outlet, a plurality of inlets for heat exchange liquid into said chamber and a plurality of outlets for heat exchange liquid from said chamber, said outlets for heat exchange liquid being transversely spaced in said chamber from said inlets for heat exchange liquid, wherein the chamber comprises a heating section and a cooling section and each said section comprises a plurality of said inlets for heat exchange liquid and a plurality of said outlets for heat exchange liquid, and wherein the apparatus further comprises means for circulating a hotter heat exchange liquid through said chamber heating section via said plurality of inlets for heat exchange liquid and plurality of outlets for heat exchange liquid in the heating section and means for circulating a cooler heat exchange liquid through said chamber cooling section via said at least one inlet and said at least one outlet for heat exchange liquid in said cooling section, so arranged as to circulate said heat exchange liquid from each of a plurality of said outlets for heat exchange liquid to a respective inlet for heat exchange liquid located more upstream with respect to said conveyor means, except that a most upstream one of said heat exchange liquid outlets, with respect to the conveyor means, or a most upstream outlet, with respect to the conveyor means, in a group of said outlets and inlets is connected to a most downstream one of said inlets, with respect to said conveyor means, or a most downstream inlet in said group and wherein said means for circulating said cooler heat exchange liquid is also so arranged as to circulate said heat exchange liquid from each of a plurality of said outlets to a receptive inlet located more upstream with respect to said conveyor, except that a most upstream one of said heat exchange liquid outlets, with respect to the conveyor means, or the most upstream outlet, with respect to the conveyor means, in a group of said outlets and inlets is connected to a most downstream one of said inlets, with respect to said conveyor means, or a most downstream inlet in said group.

13. Apparatus as claimed in claim 12, further including a holding section between said heating section and said cooling section, said holding section comprising at least one said inlet for heat exchange liquid and at least one said outlet for heat exchange liquid.

14. Apparatus as claimed in claim 13, further including means for heating the heat exchange liquid used in said holding section.

15. Apparatus as claimed in claim 12, further comprising heat exchange means for exchanging heat between heat exchange liquid exiting from a most upstream outlet with respect to said conveyor means in the heating section and heat exchange liquid exiting from a most upstream outlet with respect to said conveyor means in the cooling section so as to reheat heat exchange liquid to be introduced at a downstream end with respect to said conveyor means of the heating section and to cool heat exchange liquid to be introduced at a downstream end with respect to said conveyor means of the cooling section.

16. A method of heating or cooling a particulate material comprising the steps of:

conveying the particulate material through a chamber by means for a mechanical conveyor whilst said particulate material is immersed in a heat exchange liquid, withdrawing some of said liquid from an upper part of the chamber at each of a plurality of points spaced longitudinally with respect to the conveyor, and reintroducing said withdrawn liquid into a lower part of said chamber at each of a plurality of points spaced longitudinally with respect to the conveyor to heat or cool aid particulate material, and to suspend said material in said upwardly flowing liquid.

17. A method as claimed in claim 19, wherein said heat exchange liquid withdrawn from each of a plurality of said outlets is reintroduced at a respective inlet located more upstream with respect to said conveyor except that a most upstream one of said heat exchange liquid outlets with respect to the conveyor or a most upstream outlet with respect to the conveyor in a group of said outlets and inlets is connected to a most downstream one of said inlets with respect to said conveyor or a most downstream inlet in said group, and wherein said withdrawn liquid from at least one said outlet is heated or is cooled prior to its reintroduction.

18. Apparatus for effecting heat exchange between a liquid and a particulate material, said apparatus comprising:

a heat exchange chamber having an inlet for particulate material and an outlet for particulate material spaced from said inlet along said chamber, material conveyor means for conveying said particulate material from said inlet to said outlet, a plurality of inlets into said chamber at a low level for heat exchange liquid spaced between said inlet for particulate material and said outlet for particulate material, a plurality of outlets from said chamber at a high level for said heat exchange liquid spaced between said inlet for particulate material and said outlet for particulate material, means for pumping said heat exchange liquid to flow through the inlets for heat exchange liquid into said chamber and from the outlets for heat exchange liquid to the inlets for heat exchange liquid so arranged as to pump said heat exchange liquid from each of a plurality of said outlets to a respective inlet located more upstream with respect to said conveyor means, except that a most upstream one of said heat exchange liquid outlets with respect to the conveyor means or a most upstream outlet with respect to the conveyor means in a group of said outlets and inlets is connected to a most downstream one of said inlets with respect to said conveyor means or a most downstream inlet in said group, whereby flow of heat exchange liquid transversely through the chamber between said inlets for heat exchange liquid and said outlets for heat exchange liquid is employed in use to suspend said particulate material in said chamber.

* * * * *